US005720223A

United States Patent [19]

Meschi

[11] Patent Number: 5,720,223

[45] Date of Patent: *Feb. 24, 1998

[54] TRANSVERSAL PERFORATING APPARATUS AND RESPECTIVE PERFORATING METHOD FOR PRINTERS FED BY CONTINUOUS PAPER

[75] Inventor: Luciano Meschi, Rosignano Marittimo, Italy

[73] Assignee: Industria Grafica Meschi S.R.L., Leghorn, Italy

[ * ] Notice: The term of this patent shall not extend beyond the expiration date of Pat. No. 5,526,744.

[21] Appl. No.: 629,345

[22] Filed: Apr. 8, 1996

Related U.S. Application Data

[63] Continuation-in-part of Ser. No. 317,638, Oct. 3, 1994, Pat. No. 5,526,744.

[30] Foreign Application Priority Data

Oct. 1, 1994 [IT] Italy ..... FI/93/A/0190

[51] Int. Cl.[6] ..... B41F 13/56

[52] U.S. Cl. ..... 101/227; 400/621; 83/324; 101/483

[58] Field of Search ..... 101/224, 226, 101/227, 483; 400/621; 83/324, 342, 286, 287, 288

[56] References Cited

U.S. PATENT DOCUMENTS

| | | | |
|---|---|---|---|
| 4,366,753 | 1/1983 | Glanz et al. | 101/227 |
| 4,538,515 | 9/1985 | Tymkewicz et al. | 101/226 |
| 4,590,859 | 5/1986 | Pou et al. | 101/227 |
| 4,603,630 | 8/1986 | Llaneza | 101/227 |
| 4,706,566 | 11/1987 | Kishine et al. | 101/224 |
| 5,000,812 | 3/1991 | Murphy | 156/268 |
| 5,119,725 | 6/1992 | Okamura | 101/226 |

FOREIGN PATENT DOCUMENTS

| | | |
|---|---|---|
| 0204866 | 12/1986 | European Pat. Off. . |
| 0228758 | 7/1987 | European Pat. Off. . |
| 3132113 | 3/1983 | Germany . |
| 8704658 | 8/1987 | WIPO . |
| 9205959 | 4/1992 | WIPO . |

OTHER PUBLICATIONS

Patent Abstracts of Japan, vol. 9, No. 94 (M-374) (1817), 24 Apr. 1985 & JP-A-59 218 876 (Shinko Denki KK).

Patent Abstracts of Japan, vol. 14, No. 527 (M-1050), 20 Nov. 1990 & JP-A-02 223 462 (Oki Electric Ind. Co. Ltd.), 5 Sep. 1990.

Patent Abstracts of Japan, vol. 6, No. 204 (M-164), 15 Oct. 1982 & JP-A-57 110 480 (Fujitsu KK), 9 Jul. 1982.

*Primary Examiner*—Christopher A. Bennett

*Attorney, Agent, or Firm*—Browdy and Neimark

[57] ABSTRACT

Transversal perforating apparatus of paper for printers fed by a continuous strip of paper (1) without lateral dragging holes. The apparatus (12) comprises a perforator roller (13) holding a blade (16) substantially transversal to and engaging on a pressure roller (14) rotating in synchronism with the perforator roller (13). Means for varying the speed of the perforator roller (13) are provided for as well as means for measuring the position of the blade (16) with respect to the paper which communicate with a central processor. It is possible, therefore, to make transversal perforations coincident with the beginning and the end of each page printed by printing heads (2.3) being able to also vary the interval between two successive perforations during the course of printing.

10 Claims, 6 Drawing Sheets

TRANSVERSAL PERFORATING APPARATUS AND RESPECTIVE PERFORATING METHOD FOR PRINTERS FED BY CONTINUOUS PAPER

CROSS-REFERENCE TO RELATED APPLICATION

This is a CIP of application Ser. No. 08/317,638 filed Oct. 3, 1994, now U.S. Pat. No. 5,526,744 the contents of which are hereby incorporated by reference.

FIELD OF THE INVENTION

The present invention generally relates to the field of printers and more precisely it relates to an apparatus for the transversal perforation of a web of paper for printers fed by a continuous strip of said web. Furthermore, the invention relates to the respective method for synchronization of the perforation of the paper with the beginning of the printed page.

BACKGROUND OF THE INVENTION

Data printers generally use paper already provided with transversal perforations for the separation of adjacent sheets and furthermore use paper having lateral longitudinal holes which allow it to be dragged by means of paper-dragging rollers provided with small teeth which engage in said holes. The paper, therefore, requires treatment upstream from printing consisting in the unrolling of virgin paper and the forming of lateral holes and transversal perforations, the perforations being produced at a fixed interval such as 12 inches. The paper is then furnished in bobbins or in packages of folded "accordion" sheets.

The presence of the lateral dragging holes normally facilitates the control of the paper during the printing step which can be carried out by means of paper-dragging rollers. The transversal perforations are, on the other hand, normally accompanied by a preceding notch which allows a sensor to inform the printer of the exact position of said perforations in order to allow the printing heads to initiate printing in correspondence to the beginning of each sheet of paper delimited by two consecutive perforations.

The need for printers operating with a continuous strip of paper to print pages of different length is strongly felt. Another requirement for such printers is high flexibility to print pages of different size without a particular preselected order, only controlled by a computer that chooses the best time to print them. Such paper should obviously lack transversal perforations which should be done substantially at the same time of printing. In these printers savings could be advantageously obtained. In fact, in this way they could be faster, since there should be no need to change the paper or to stop the printer when the length of the page changes. Moreover, less waste of paper would result as a consequence of the minimum number of changes and stops in the printer. These two savings are advantageous to large printer users, such as banks, utilities companies, firms, etc. with large numbers of clients to whom it is necessary to communicate information such as invoices, financial statements, bulletins, etc.. The quantity of paper in circulation is enormous, and printers able to satisfy volumes of this nature operate at a considerable velocity, for example 50–100 cm/sec and faster.

Many existing data printers at the output produce, by means of shears, single sheets obtained from the strip of paper printed back and front. The use of the shears makes transversal perforations unnecessary, whereas the absence of the dragging holes is compensated for by processing the paper taut. The control of the beginning position of each printed sheet occurs in correspondence to the printing beads which send corresponding signals' to a central processing unit which also commands the shears at the output.

In many cases, for the control of the quality and accuracy of the printed data, it is necessary that the paper exiting the printer still be in a continuous strip, and produced in folded, "accordion," packages. In such cases, it is necessary for the paper, at the beginning of printing, to already have the transversal perforations suitable to allow the tearing apart from one another of adjacent sheets of paper in a later step.

This characteristic, however, implies certain difficulties which currently cannot be overcome in the case that one wishes to carry out printing of pages of different sizes.

SUMMARY OF THE INVENTION

Accordingly, the present invention has an object, among others, to overcome deficiencies in the prior art such as noted above.

The object of the present invention is to provide an apparatus for the transversal perforation of paper to insert in printers fed by a continuous strip of paper in order to allow for the above mentioned savings.

A further object of the present invention is to provide a method for the transversal perforation, within the printer, of a strip of paper or similar material in synchronism with the beginning of each printed sheet.

These objects are accomplished by the transversal perforating apparatus according to claim 1 and by the method according to claim 8 for transversal perforation of a strip of paper within a printer.

BRIEF DESCRIPTION OF THE DRAWINGS

Further characteristics and advantages of the transversal perforating apparatus according to the invention and the respective method of perforation will become more apparent in the following description of one of its possible embodiments, given as an example and not limitative, with reference to the attached drawings in which.

DESCRIPTION OF THE PREFERRED EMBODIMENT

Figure 1:
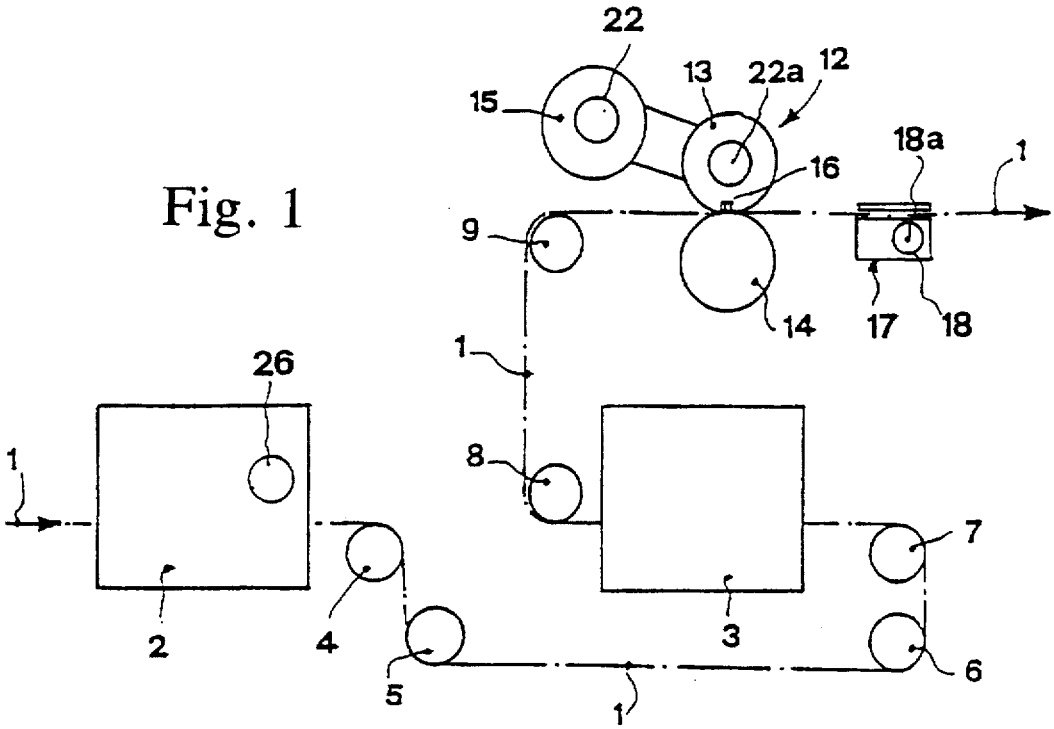
FIG. 1 is a schematic view of a transversal perforating apparatus according to the invention placed downstream from two printing units.
Figure 2:
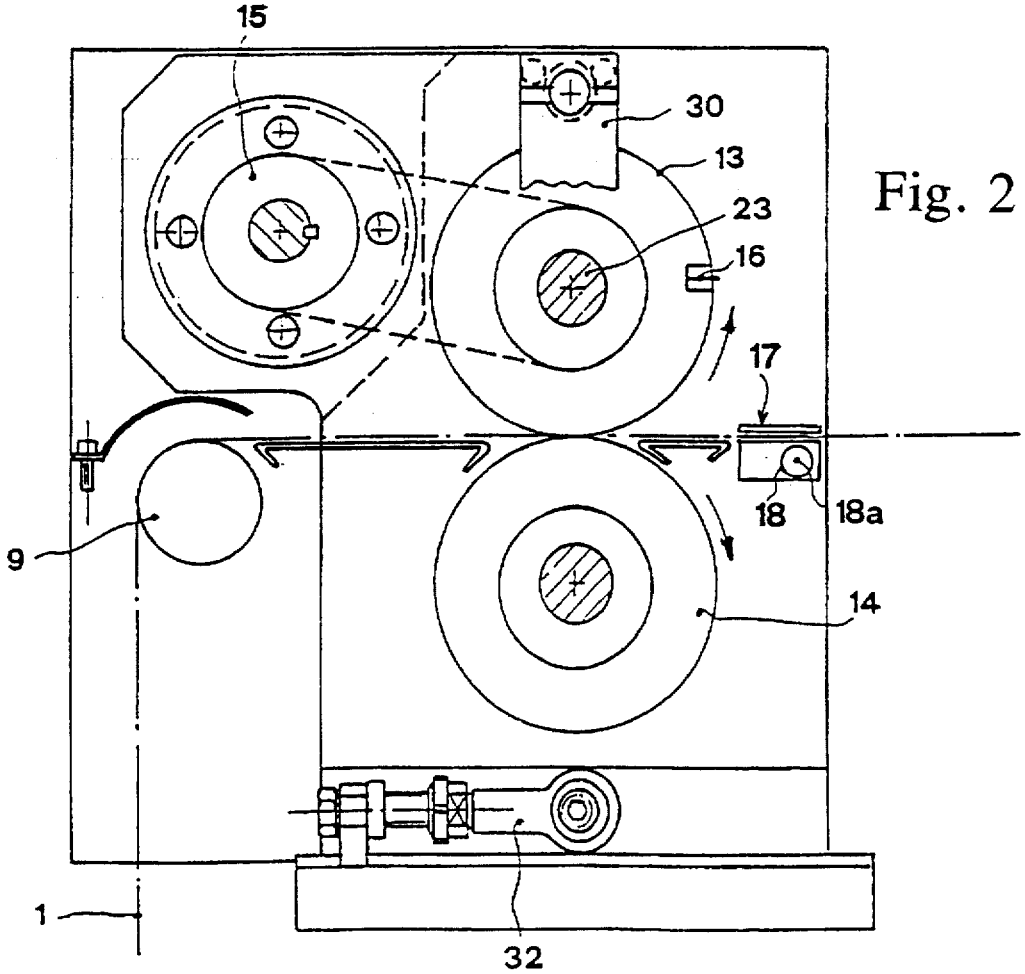
FIGS. 2, 3, and 4 show the printing apparatus of FIG. 1 respectively in a side sectional view, a bottom view and a transversal sectional view.
Figure 7:
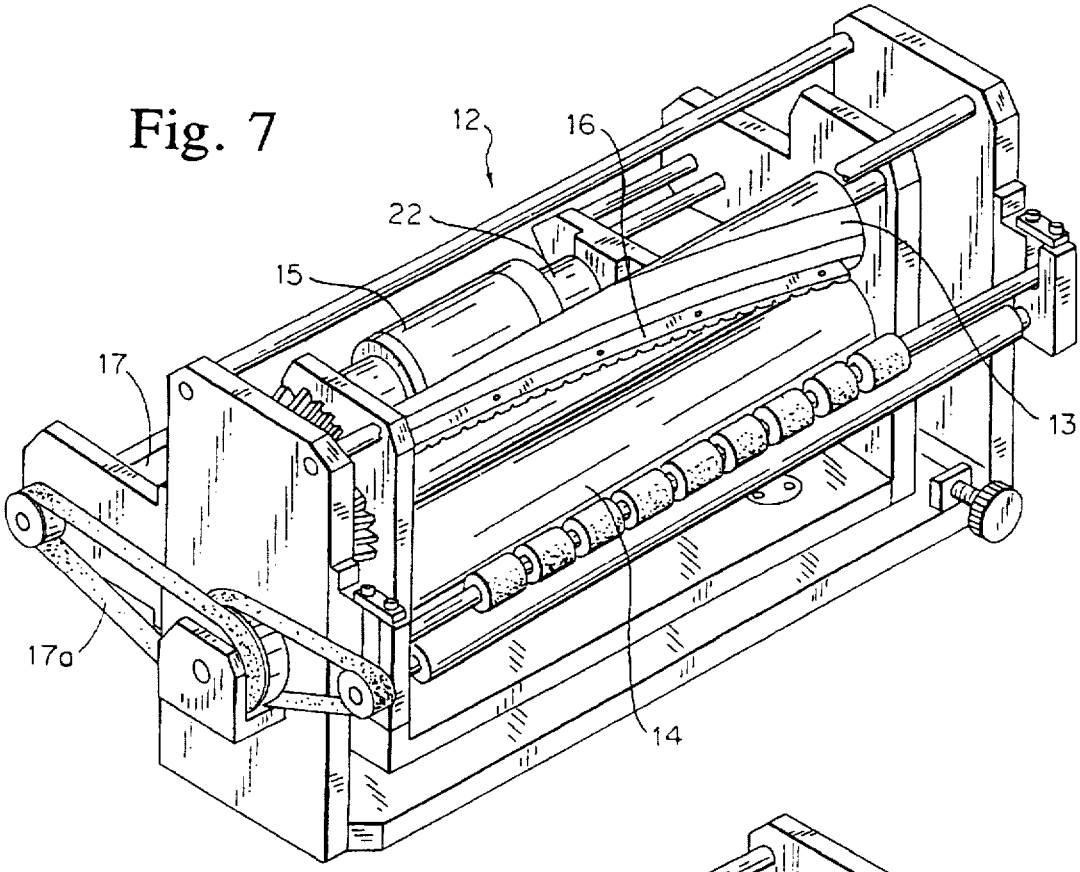
FIGS. 7 and 8 show a front and rear perspective view of an apparatus according to the invention.
Figure 8:
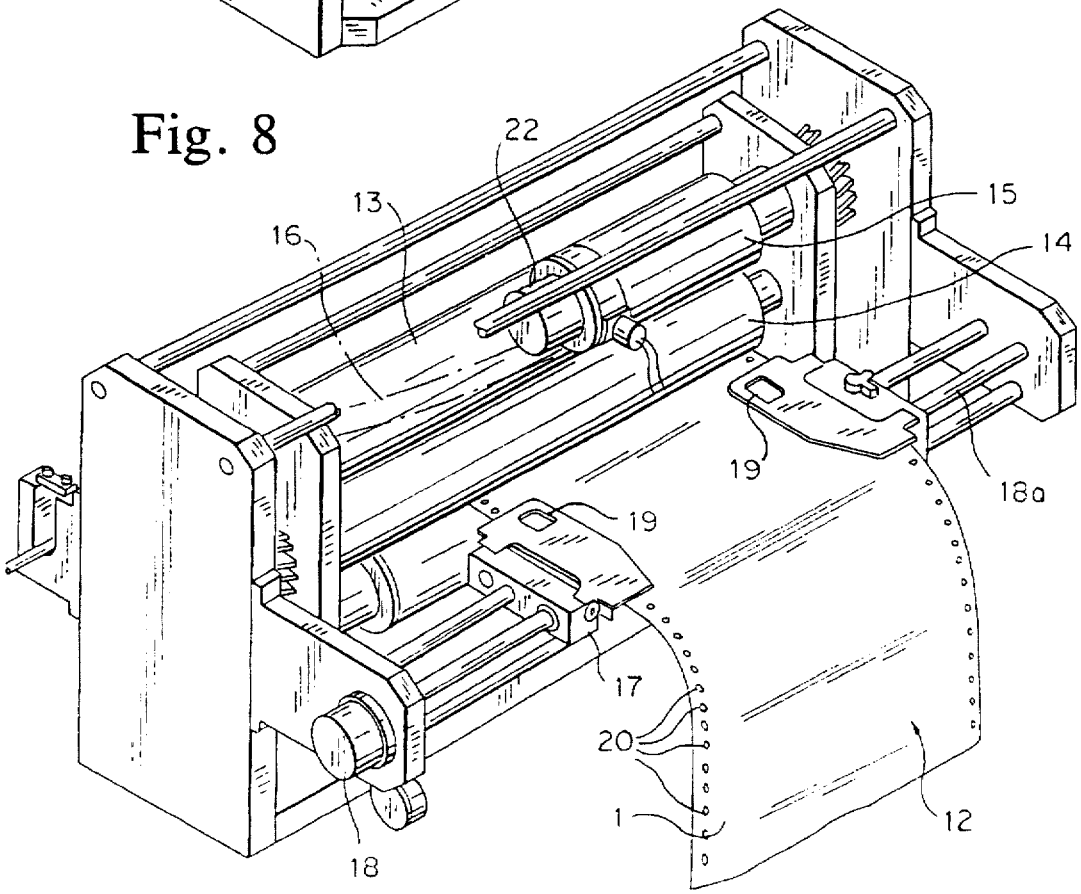

With reference to FIG. 1, a printer printing on a continuously fed strip 1 of paper comprises a printing head 2, acting on one face (front) of strip 1, and a second printing head 3 for the printing 6*f* the other face (back) of the paper. The paper is guided by deflector rollers 4, 5, 6, 7, 8 and 9 in its advancement from printing head 2 through head 3 to reach a perforating apparatus 12 comprising a perforator roller 13 and a pressure roller 14 rotating in the direction opposite one another and driven by a motor 15. Perforator roller 13 has a blade 16 in a position substantially transversal to paper 1 so as to produce a perforation 20 on it (see FIG. 11) with each rotation of roller 13 itself, because the paper is interposed between blade 16 and roller 14. A dragging device 17, which is operated via a belt 17*a* as shown in FIG. 7 by engine 15, provides for the dragging of the paper and is located downstream from perforating apparatus 12. Device 17 is of a known type and has inner toothed sprocket wheels 21 (visible in FIG. 10 in a slightly different embodiment of the apparatus) engaging in lateral dragging holes 20 provided along either side of paper strip 1. As shown also in FIG. 8, an encoder 18, which is preferably an incremental encoder with index signal, is integral with the axis 18*a* of said rollers and a window 19 is made on dragger device 17. The position of window 19 coincides with a position of zero starting from which encoder 18 calculates the extension of paper 1 at the initialization of a new strip.

To more fully explain: as the strip 1 moves over the wheels 21, it rotates shaft 18*a* along which the two sprockets 21 are longitudinally slidable but around which they cannot rotate. The shaft 18*a* passes through the frame into the encoder 18, which is fastened to the frame, and turns an internal encoding element of the encoder 18 (not shown). The devices 17 are held from rotating by being slidably mounted on both the rotatable shaft 18*a* and a second member parallel to the shaft, but can slide along the rotatable shaft 18*a* to accommodate strips 1 with different widths or positions.

On the axis of engine 15, as shown in FIGS. 1, 2, 7 and 8, an encoder 22 is-provided, which is for example an incremental encoder capable Of determining also the direction of rotation the engine, measures the rotation completed by blade 16, thus allowing for the identification of the exact position in which each transversal perforation must be carried out. Thus, the two encoders 18 and 22 together locate both the paper strip 1 and the cutting blade 16, making it possible to correlate the position of the cutting edge with a longitudinal position along the paper strip 1.

An auxiliary reference encoder 22*a* is preferably provided for on roller 13 which detects precisely the position of blade 16. Encoder 22*a*, in fact, is integral to roller 13, whereas encoder 22 is integral to the axis of engine 15. Therefore, encoder 22 is necessary to control directly the engine and encoder 22*a* is useful to control the position of the blade. Encoder 22*a*, however, could be not present if an high precision of the position of the transversal perforation is not necessary.

Figure 3:
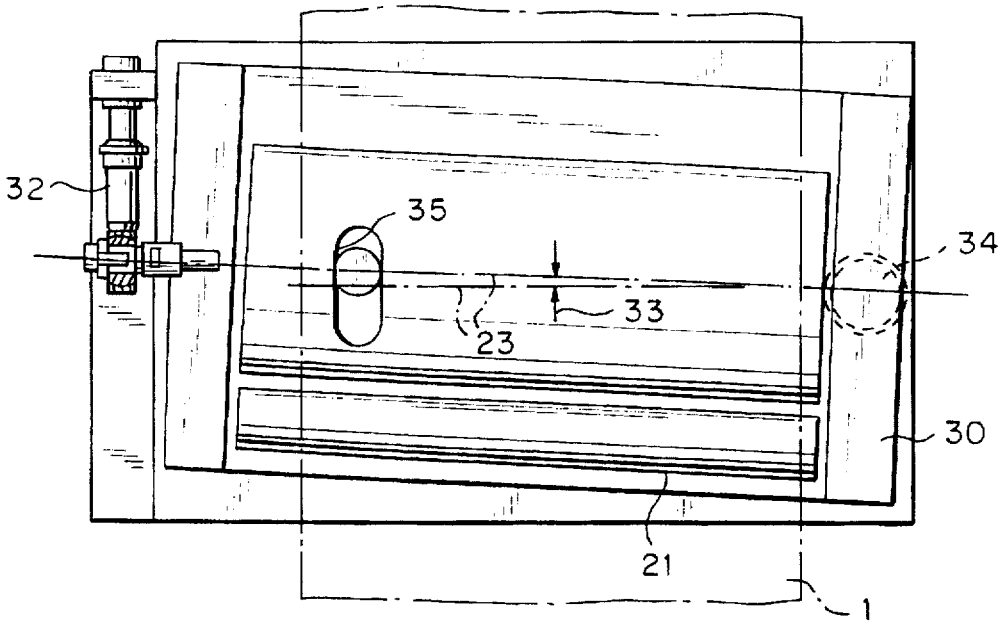
Figure 4:
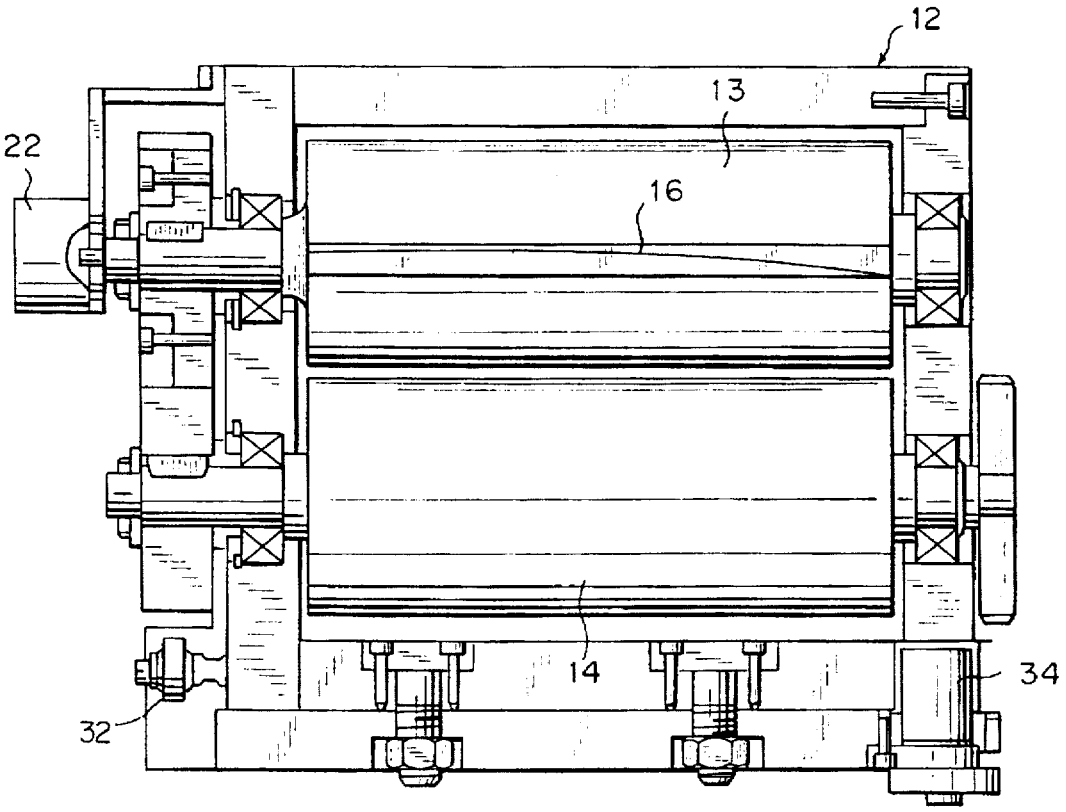

Preferably, as shown in FIG. 4, blade 16 is helicoidal, instead of rectilinear, on the surface of roller 13. The axis 23 of roller 13 is not orthogonal to paper 1, but inclined and mounted on a support 30 (FIG. 3) which allows for the regulation of its inclination. This regulation is possible through screw means 32 which can vary the inclination 33 of axis 23 with respect to a fixed pivot 34 and a slot guide 35. As is known, a helicoidal blade produces a rectilinear cut on a strip of paper advancing at a predetermined speed, provided that the plane containing the axis of inclination of the blade is inclined by a predetermined degree so that the contact points of the blade, as it descends on the paper, lie on a line orthogonal to the advancement of the paper. In this case helicoidal blade 16 is applied to a roller 13 whose axis 23 is advantageously regulated, in order to adjust the position of the blade so that the perforation is made on the paper orthogonally to the longitudinal border thereof. The inclination of the roller is normally set when the blade is changed and is a function of the pitch of the blade helix. It is important that the tip speed of the roller 13 coincides with that of paper 1 during perforation.

The speed of roller 13 and blade 16 can be varied as shown in the graphs of FIGS. 6A, 6B, 6C and 6D. This can be done by varying the voltage on the motor 15, for example. The horizontal axis in these figures, labeled "t", represents time. However, since the strip 1 travels at a constant speed, the horizontal axis could alternatively represent the distance or length along the strip 1, at a constant speed time and distance travelled being proportional. The vertical axis, labeled "V", represents the peripheral velocity of the roller 13; the constant strip speed is indicated by the particular value Vp. Considering the three cases A, B, C (corresponding to the graphs 6A, 6B, and 6C respectively) it is seen that the roller 13 accelerates and decelerates so that the velocity of the blade 16 matches the strip speed Vp at the instants (indicated by vertical dashed lines) when the blade is in contact with the strip 1. This allows the strip 1 to be cut without tearing.

Figure 11:
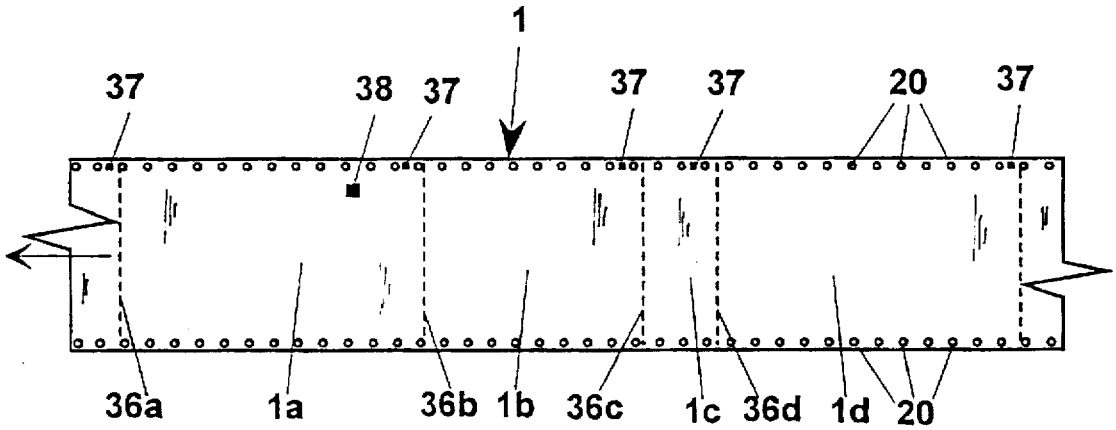
FIG. 11 is a top plan view of a portion of paper transversally perforated by means of the apparatus according to the invention.

It is thus possible, according to the present invention, to produce transversal perforations at any predetermined distance from one another, as shown in FIG. 11 where after printed sheet 1*a*, comprised between transversal perforations 36*a* and 36*b* (for example at 11+⅞ inches), a second printed sheet 1*b* having the same length comprises a shorter portion 1*c* (for example 4 inches long) between transversal perforations 36*b* and 36*c*. Then follows a third printed sheet 1*d*, between perforations 36*c* and 36*d*.

Figure 6A:
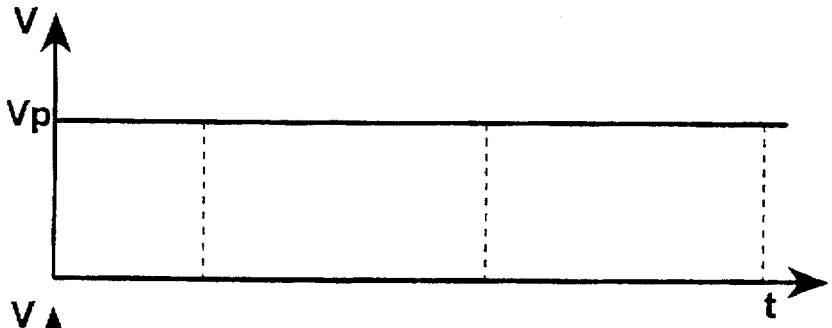
FIGS. 6A–6D show a diagram of variations in the rotational speed of the perforator roller of the apparatus according to the invention.
Figure 6B:
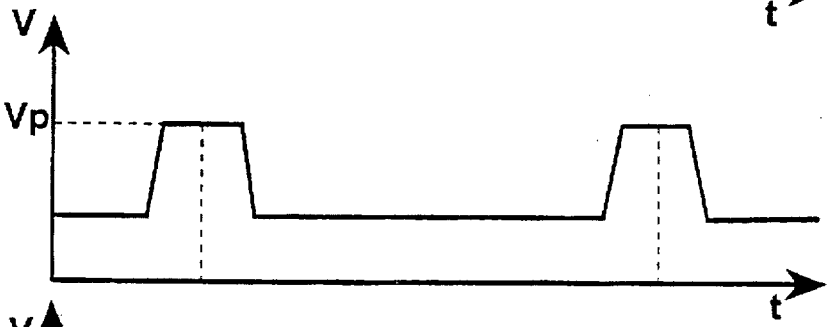
Figure 6C:
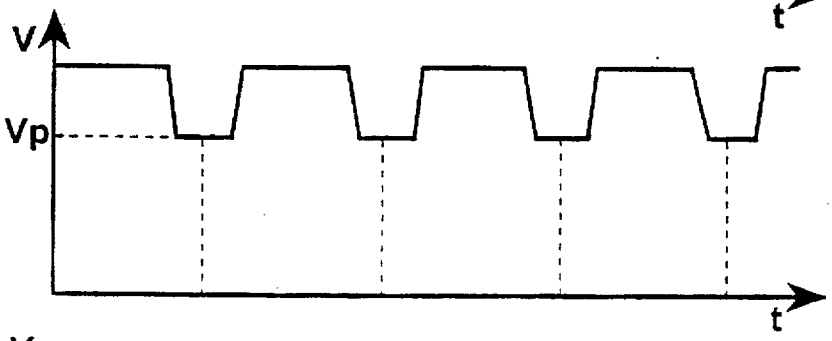
Figure 6D:
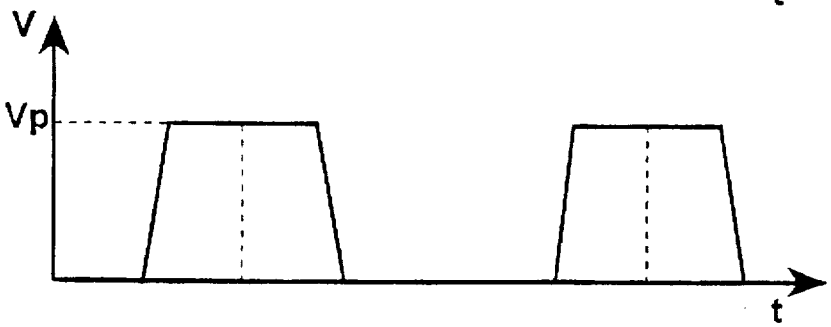

This result can be obtained, as shown in the diagram of FIG. 6A–6D, by varying the speed of roller 13 in each period in which the perforation does not occur, the frequency of the contacts between blade 16 and paper 1 can be varied. In case A, for example, the rotation of roller 13 occurs at a constant speed equal to the speed of paper 1, and, therefore, the distance between two consecutive perforations is equal to the circumference covered in one rotation of blade 16. In case B, apart from the exact instant of the cut, roller 13 slows allowing more paper to pass, thus obtaining a longer time interval between two consecutive perforations. In case C, inversely, the time interval between two consecutive perforations is shorter than in case A, using a greater rotation speed of roller 13 with respect to the advancement speed of the paper except for the period surrounding the instant of the cut. As shown in FIG. 6D, a preferred embodiment of case of FIG. 6B has roller 13 which stops after each perforation instead of slowing down. The perforations 36*a*, 36*b*, 36*c* and 36*d* of FIG. 11 could therefore be obtained as a combination of cases of FIGS. 6C and 6D.

Figure 5:
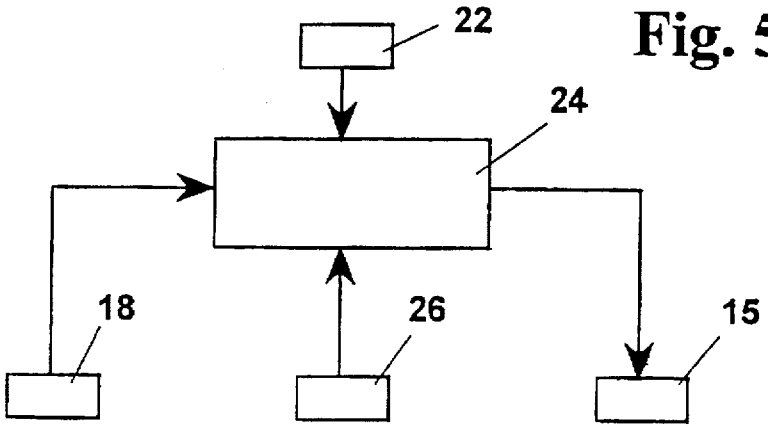
FIG. 5 shows a diagram of connections between the perforating apparatus according to the invention and a central processor.

The instant of the cut is communicated by encoder 22 to a central processor 24 (FIG. 5) which at the same time receives the data of the printing head 3 and of dragging device 17 provided by respective encoders 26 and 18. Encoder 26, shown in FIG. 1, is integral with the axis of the printing roller (not shown) of printing head 3. Printing is initiated by head 2, in synchronism with head 3, so that the printing on the front and back of the paper coincide. The two perforations that delimit each sheet are then performed automatically by the perforating apparatus 12 and coincide with the beginning and end of the page itself.

More precisely, this result is achieved by virtue of the presence of encoder 22 coupled to the rotational axis of roller 13 of perforating apparatus 12. In fact, encoder 22 (optionally along with encoder 22*a*) controls the position of blade 16 of roller 13 and informs processor 24, which can be programmed in a manner known to a person skilled in the art, in order to correspondingly accelerate or decelerate the speed of engine or motor 15 depending on the selected distance between two successive transversal perforations.

For example, assuming that the encoders 26, 22, and 18 all register position (in terms 6*f* a rotational angle, for example), the processor 24 may include a program for determining a required average speed of the roller 13. To do so, it would first determine the speed of the strip 1 by differentiating the output of the sensor 18. (Such differentiation can be done using the clock of the processor 24, dividing the sensor output by the number of clock pulses.) The processor can then use the strip speed to find the rotational speed of the roller 13 desired during the times when the blade 16 is cutting the strip 1 (Vp in FIGS. 6A–6D), by a simple proportion involving the radius of the roller 13. Then, the processor 16 may determine the non-contact speed, less than or greater than the speed Vp, as is described further below.

At the startup, when the whole printing machine is set, the paper is put in dragging device 17 so that a toner marker 38, shown in FIG. 11, printed by head 3 on a series of pages at the beginning of the strip coincides with window 19. At that position the zero is set in processor 24 so that the measurement of the extension of the paper is calculated by encoder 18 starting from that point. In this way the axis control on head 3 by encoder 26 is synchronized with axis control on encoder 18 and the beginning of each page. The distance between encoder 18 and the perforating position of blade 16 is measured and stored in processor 24. In this way, the latter can calculate the exact correspondence between the beginning or end of each printing page signaled by encoder 18 and the cutting moment, related to encoder 22.

Figure 9:
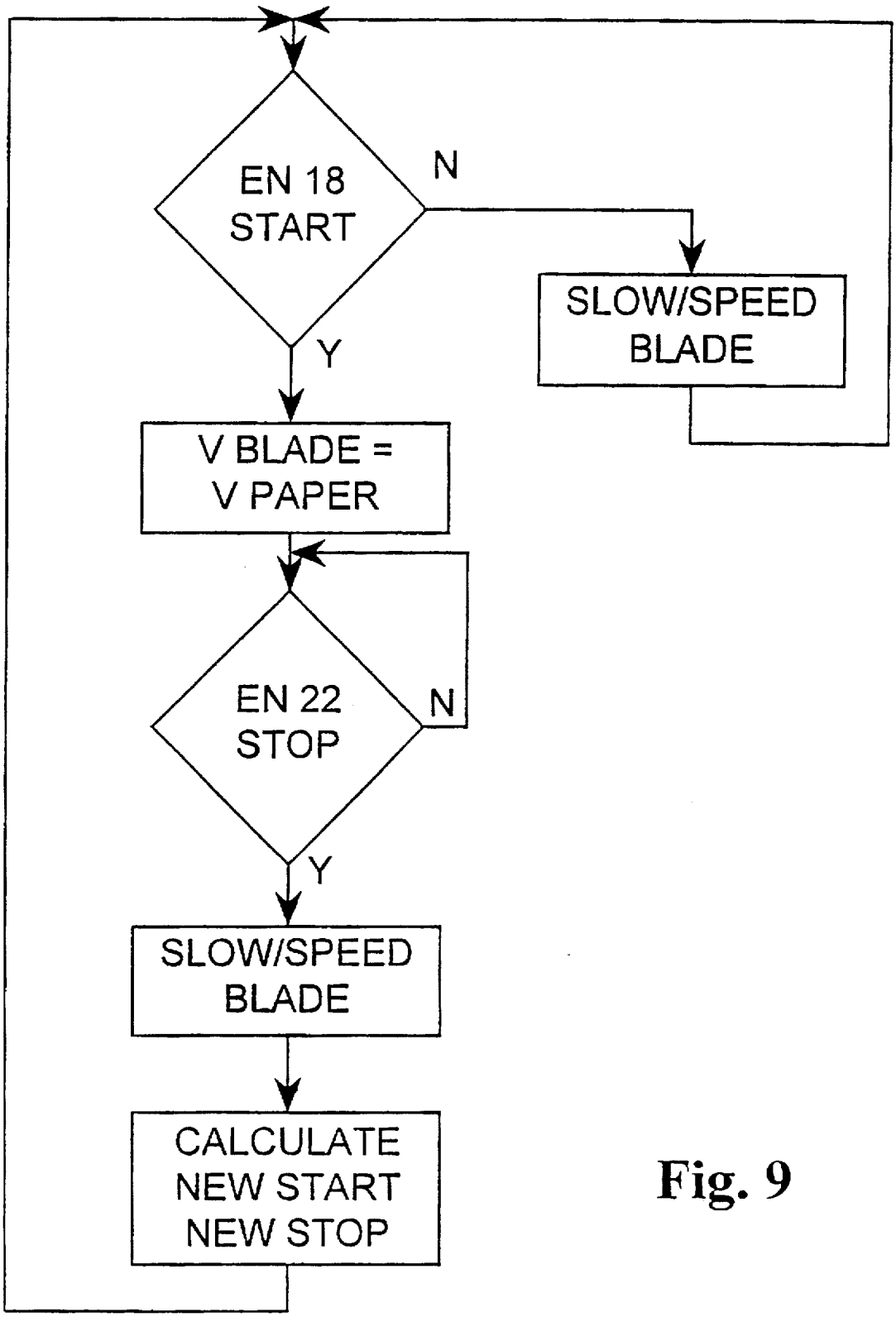
FIG. 9 shows a diagrammatic flowchart illustrating the main calculation step of the processor which controls the apparatus.

In more detail, when encoder 18 has measured a linear extension of the paper equal to the distance existing between the beginning of the printed page on head 3 via encoder 26 and the perforating position under blade 16, the perforation must occur in that moment. Roller 13, therefore, should be previously accelerated or decelerated as shown in FIGS. 6A–6D so that blade 16 is ready to perforate just in that moment. A diagrammatic flowchart showing the main calculation step of the processor is illustrated in FIG. 9, where the logic relationship between encoder 18, controlling the position of the paper, and of encoder 22, controlling the position of the blade, is shown. Processor 24 controls when encoders 18 and 22, which are incremental encoders (for example of the type SICOD D78 360 5 B CV01), reach a reference start position and a stop position respectively, calculated at the previous step. After having made a perforation, encoder 22 reaches a stop position and the processor slows or speeds the blade. This condition does not change until encoder 18 has reached again the start position, in which the processor imparts to engine 15 a speed so that the speed of roller 13 and 14 are the same and the blade is proximal to the cutting position. In case the printing head 3 prints a page of different length, this is communicated to processor 24 which calculates a new start and stop position for encoder 18 and 22.

Figure 10:
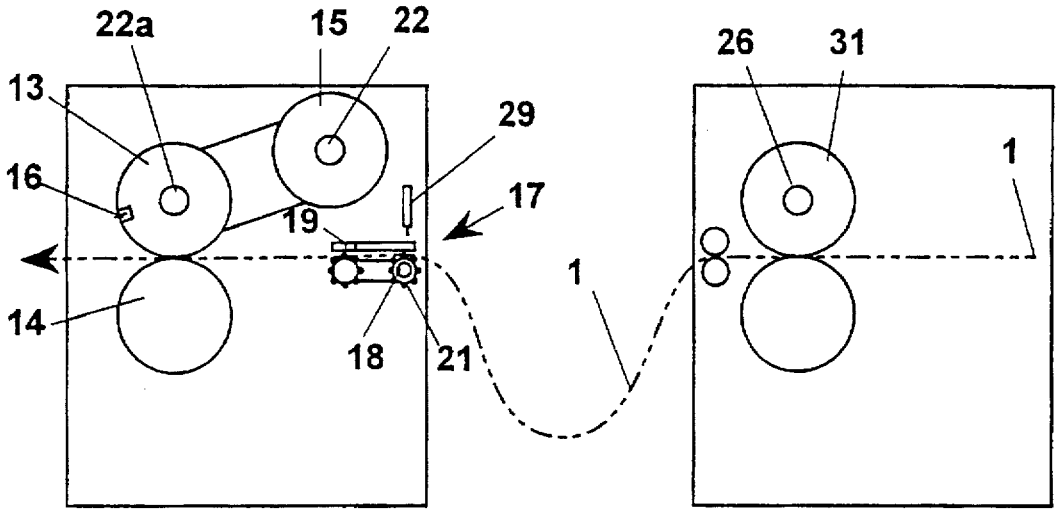
FIG. 10 is a schematic view of a transversal perforating apparatus according to the invention placed downstream from a single printing unit.

According to another embodiment of the invention, shown in FIG. 10, a printing unit 31, having encoder 26 on one of his rollers, prints on paper 1 an optical code or a bar code 37 (shown in FIG. 11) comprising the information on the length of the printed sheet. Differently to the previous embodiment, the dragging device 17 is placed upstream of perforating roller 13. The code is read when the paper reaches the perforating apparatus at the dragging device 17 by means of an optical sensor 29 (for example of the type DATALOGIC T29) and communicated to central processor 24 which determines the position of the transversal perforations according to the signal coming from encoder 18 associated to sprocket wheel 21.

It is, therefore, possible to obtain the continuous printing of paper not yet provided with transversal perforations, and produce transversal perforations in exact coincidence with the beginning and end of each page with high precision.

A printer which comprises the perforating apparatus according to the present invention is, therefore, very flexible in that it allows the variation, in rapid succession, of sheet sizes of paper without having to stop the printer itself. According to known techniques, on the other hand, it would have been necessary to use perforated paper at a fixed interval, each variation of the interval between two successive perforations requiring a change of the paper causing a considerable loss of time.

The foregoing description of the specific embodiments will so fully reveal the general nature of the invention that others can, by applying current knowledge, readily modify and/or adapt for various applications such specific embodiments without undue experimentation and without departing from the generic concept, and, therefore such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A transverse perforating apparatus for perforating a paper web from a printer, said printer being fed by a continuous strip of the web with lateral dragging holes and provided with a printing head crossed by said strip; the apparatus comprising:

processing means for controlling a linear position of the strip, said means for controlling communicating with a central processor;

a perforator roller having an axis substantially orthogonal to said strip and holding a blade substantially transversal to said strip;

a pressure roller pressing against said blade at every rotation of said perforator roller;

variation means for varying the speed of said perforator roller;

measuring means for measuring the position of said blade with respect to said strip, said measuring means communicating with said central processor;

said processor calculating the position of said strip as communicated by said control means; and said variation means accelerating or decelerating said perforator roller, during each period comprised between two successive perforations.

2. The apparatus according to claim 1, wherein said measuring means comprise an encoder integral with said axis of said perforator roller.

3. The apparatus according to claim 1, wherein said measuring means comprise an encoder integral with said variation means for varying the speed of said perforator roller.

4. The apparatus according to claim 1, wherein said measuring means comprise an encoder integral with said axis of said perforator roller and an encoder integral with said variation means for varying the speed of said perforator roller.

5. The apparatus according to claim 1, wherein a dragging device is provided downstream of said perforator roller, and said control means comprises an encoder mounted on said dragging device and an encoder mounted on said printing head.

6. The apparatus according to claim 1, wherein said blade has a helicoidal form and comprising a support on which said perforator roller is mounted and which further comprises inclining means for inclining said support with respect to a direction orthogonal to said strip.

7. The apparatus according to claim 1, wherein a dragging device is provided upstream of said perforator roller, and said control means comprises an encoder mounted on said dragging device, an encoder mounted on said printing head, and an optical sensor at said dragging device directed towards said strip of paper.

8. A method for transverse perforation within a printer having printing heads of a strip of paper and a similar material with lateral dragging holes in synchronism with the beginning and end of each printed page, comprising the steps of:

dragging of said paper through a perforating apparatus to produce transverse perforations on the strip; measuring the linear extension of said strip crossing the printing heads of said printer;

calculating a position corresponding to the beginning of each printed page; and varying the speed of the perforating apparatus, as a function of the distance between the beginning and the end of each printed page, during each interval between two successive perforations.

9. The method according to claim 8, wherein said strip has a toner marker printed by said printing heads at its beginning and, said step of calculating the position corresponding to the beginning of each printed page being initialized starting from said toner marker.

10. The method according to claim 8, wherein each printed page has a code printed at a fixed distance from its beginning or end and, said step of calculating the position corresponding to the beginning of each printed page being carried out starting from said code.

* * * * *